United States Patent [19]

Fredd

[11] 4,252,188

[45] Feb. 24, 1981

[54] ACTUATOR

[75] Inventor: John V. Fredd, Dallas, Tex.

[73] Assignee: Otis Engineering Corporation, Dallas, Tex.

[21] Appl. No.: 59,666

[22] Filed: Jul. 23, 1979

[51] Int. Cl.[3] ..... E21B 34/08; E21B 43/12; E21B 47/06

[52] U.S. Cl. ..... 166/188; 166/113; 166/319; 166/332

[58] Field of Search ..... 166/188, 332, 334, 72, 166/243, 98, 264, 128, 250, 319, 113

[56] References Cited

U.S. PATENT DOCUMENTS

| | | | |
|---|---|---|---|
| 2,619,179 | 11/1952 | Armentrout | 166/319 X |
| 2,747,673 | 5/1956 | Lawrence | 166/98 |
| 2,965,175 | 12/1960 | Ransom | 166/98 |
| 4,050,512 | 9/1977 | Giebeler | 166/128 |
| 4,113,012 | 9/1978 | Evans et al. | 166/26 X |

*Primary Examiner*—Stephen J. Novosad
*Attorney, Agent, or Firm*—Vinson & Elkins

[57] ABSTRACT

An actuator for shifting a mandrel. The actuator is responsive to external ambient pressure and to internal ambient pressure and a differential in pressure shifts a mandrel carried by the actuator against the resilience of a spring. The actuator is disclosed as a part of a testing system. The system employs a packer, a foot valve, a landing nipple and a transducer fitting, all of which may be first run and landed in the well. The tubing is then run with a circulating tool and dump valve. The actuator of this invention may be run on the free end of the tubing, landed in and sealed with the bore wall through the packer and carry the actuator for opening and closing the foot valve.

7 Claims, 2 Drawing Figures

ACTUATOR

Figure 1:
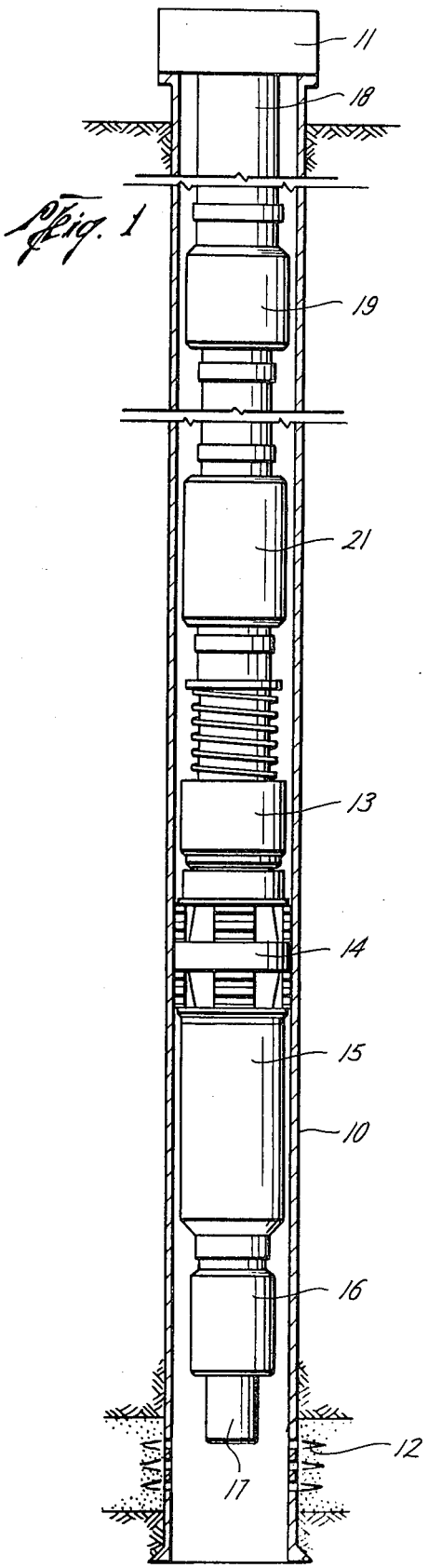

This invention relates to actuators. In one form it relates to an actuator which may form a part of a tubing string and be utilized to operate a foot valve depending from a packer in which the actuator is landed.

It is an object of this invention to provide an actuator which may be run as a part of a tubing string and which will operate in response to a differential between tubing and casing pressure to control the position of a foot valve depending from a packer in which the actuator is landed.

Another object is to provide an actuator which operates in response to pressure conditions against the force of a resilient means and in which plural constant volume hydraulic chambers are utilized to positively move the actuator's shifting mandrel in response to movement of the control piston in either direction.

Another object is to provide an actuator and particularly an actuator for a well tool in which force is hydraulically transmitted between operating pistons in the actuator and multiple hydraulic chambers are provided for transmitting force in opposite directions so that as a piston moves in either direction the responding piston is positively moved.

Another object is to provide an actuator as in the preceding object in which the actuating piston forming a portion of one of the hydraulic chambers is made in two telescoping parts to prevent a fluid lock and to permit a visual test of both hydraulic chambers to insure that they are substantially filled with hydraulic fluid.

Another object is to provide an actuator which may be made up on the lower end of a tubing string and run into a previously set packer having a foot valve thereon in which the actuator controls the opening and closing of the foot valve in response to differential in tubing and casing pressure.

Other objects, features and advantages of the invention will be apparent from the drawing, the specification and the claims.

IN THE DRAWINGS

Figure 2:
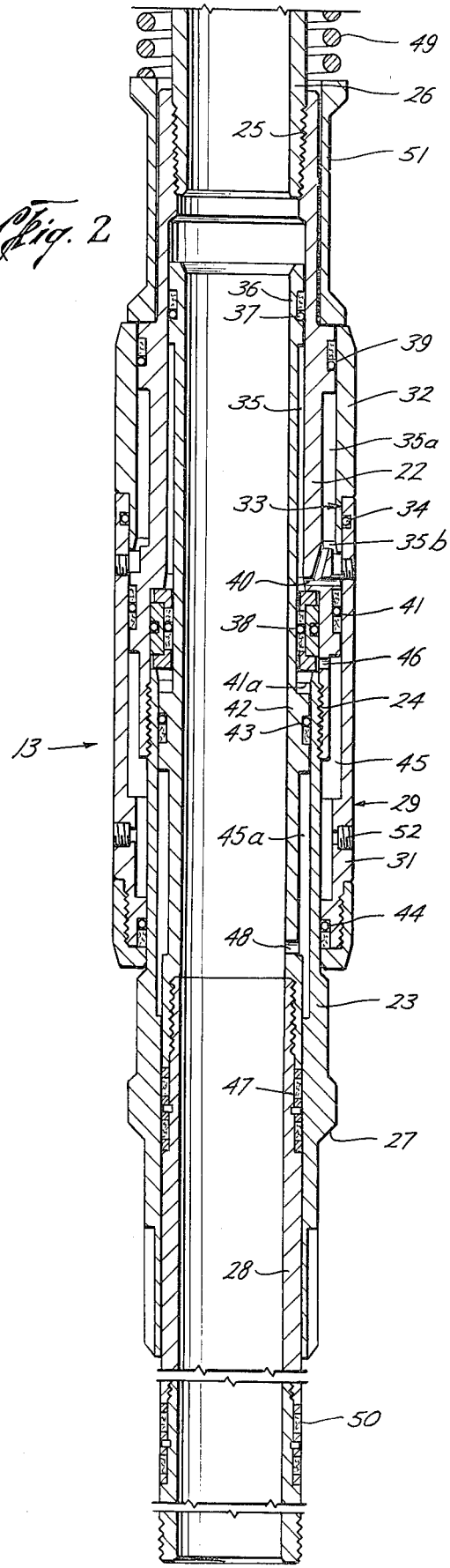

In the drawing wherein an illustrative embodiment of this invention is shown,

FIG. 1 is a schematic illustration of a well test installation employing the actuator of this invention; and FIG. 2 is a cross-sectional view through an actuator constructed in accordance with this invention.

Referring first to FIG. 1, there is shown a well having a casing 10 and standard surface equipment 11 at the top of the well. The casing and well are shown to be perforated at 12 into the formation to be tested.

Within the well there is an assembly made up of a packer 14, foot valve 15, landing nipple 16, and transducer fitting 17 which are preferably run into the well and landed in place in a preliminary operation as by conventional wireline techniques.

The test or production pipe which may be a drill stem but is preferably a production tubing 18 is shown to have a circulating valve 19, a cushion valve 21, and an actuator 13 with the tailpipe or actuator mandrel of the actuator unit in sealing engagement with the packer 14. During the running of the tubing 18, the cushion valve may be utilized to support a column of fluid in the tubing which is released by opening of the cushion valve when the string engages the packer 14. The circulating valve 19 may be utilized as needed. It is normally closed but conditions may arise when it is desirable or imperative to provide for circulation between the casing-tubing annulus and the tubing. The circulating valve 19 may be quickly and readily opened for such circulation.

The packer 14 packs off the producing formation and the foot sleeve valve 15 controls the flow through the foot sleeve and into the tubing. The landing nipple and transducer fitting provide for landing a transducer such as a pressure sensing device within the fitting to sense the pressure in the casing and below the packer. With this assembly, static pressure in the formation below the packer as well as build-up pressure can be recorded or transmitted to the surface through a suitable electric line and flow can be provided through the foot sleeve valve to test the flow characteristic of the well.

The actuator of this invention which is sometimes referred to as a seal unit because it seals with the packer 14, may be used in any desired setting. It was developed, however, to form a part of the testing system shown and its construction and operation will be explained in this setting. The invention, however, is not restricted to the system shown and the actuator may be positioned other than in the relationship shown.

In the system shown the foot sleeve valve 15 is shown to be carried by the packer 14 and to have attached to its lower end additional equipment such as the landing nipple 16 and the transducer fitting 17 which close the lower end of the assembly. Of course, other or different equipment could be dependent from the sleeve valve 15.

A detailed illustration of the preferred form of foot valve 15 is shown in my co-pending application for "VALVE", executed the 18th day of June, 1979, and filed on the 2nd day of July, 1979, and given the Ser. No. 053,782, the disclosure of said co-pending application is incorporated herein by reference. While other types of foot valves might be used which are opened and closed by vertical shifting of a mandrel, the particular foot valve shown in FIG. 2 of said co-pending application is preferred.

Referring now to FIG. 2, the preferred form of this actuator is shown generally at 13. The actuator includes a tubular body provided by the upper body 22 and the lower body 23 connected together as by the thread system indicated at 24. The upper body is provided with an internal thread 25 to connect the actuator to the spring carrier 26 which in turn may be connected to the lower end of a well pipe, which may be a drill string but is preferably a production tubing such as tubing 18. The lower body section 23 is designed to extend into the upper end of a conventional packer 14 and is provided with an enlarged annular portion 27 to rest on the top of the packer and prevent further downward movement of the actuator.

A tubular mandrel 28 is reciprocal in the body. The lower end of the mandrel 28 is threaded and is adapted to be connected to a shifting tool such as the shifting tool indicated at 39 in the above identified co-pending Fredd application. Thus by shifting of the mandrel 28 in accordance with this invention, the foot valve shown in my co-pending application may be shifted between open and closed positions.

A piston 29 is reciprocal with respect to the body as is, of course, the mandrel 28. For reasons which will appear hereinafter, the piston indicated generally at 29 is made of a lower piston section 31 and an upper piston section 32. These two piston sections are telescoped together as indicated generally at 33 and a sliding seal 34 seals between the two piston sections 31 and 32.

In order to transmit force from movement of the piston 29 to the mandrel 28 plural fluid chambers are provided which will transmit force.

The upper fluid chamber 35-35*a* includes the upper piston 36 on the actuator mandrel 28. Communication between the chambers is provided by port 40. A suitable seal such as O-ring 37 seals between the upper body 22 and the piston 36. An intermediate seal means indicated generally at 38 seals between the body 22 and the mandrel 28. Additional seal means are provided between the body 22 and the piston 29; these seals being shown at 39 and 41. The seals 36 and 38 as well as the seals 39 and 41 are spaced from each other and permit reciprocal movement of the mandrel 28 and the piston 29 relative to the body while maintaining a substantially constant volume in the chamber 35.

In like manner an additional constant volume hydraulic fluid chamber is provided. The mandrel 28 has at a lower level a lower piston 42 and suitable seal means 43 provide a sliding seal between the lower piston and the body. An additional seal means 44 is provided between the piston 29 and the body. The four seal systems 38, 41, 43 and 44 together with the body, mandrel 28 and piston 31 define a second constant volume chamber 45-41*a* with the two parts of the chamber interconnected by port 46 in the body.

The lower end of the mandrel 28 may be provided with one or more packing systems 50 for sealing between the mandrel and the packer 14. Seal 47 isolates the interior of the actuator and tubing 18 from the casing-tubing annulus.

To provide an area on the mandrel 28 responsive to tubing pressure, the seal 43 is of a greater diameter than the seal 47 and an access port 48 is provided to permit pressure internal of the mandrel to be effective on this differential seal area.

In like manner the actuator piston 29 is dimensioned such that the seal 39 is of greater diameter than the seal 44, thus providing a pressure responsive area facing downwardly on the piston.

A resilient means such as the spring 49 is positioned to exert a downward pressure on spool 51 which in turn contacts the upper end of the piston 29.

Thus, with the two hydraulic chambers filled with fluid pressure internally and externally of the actuator, that is, tubing and casing pressure will be effective respectively on the mandrel 28 and the piston 29 urging both in an upward direction and the spring 49 will be urging the piston 29 in a downwardly direction.

It is highly desirable that the two hydraulic chambers be full or substantially full of hydraulic fluid and all air if possible should be removed from these chambers. To insure that little or no air remains in the two hydraulic chambers, they are first both filled with hydraulic fluid and then tested. A plug 52, being one of several fill plugs provided in the piston section 31 may be removed and a source of pressure applied to the chamber 45-41*a* through the port normally closed by the plug 52. Pressure should be applied to the chamber 45-41*a* until the upper piston 32 separates from the lower piston 31. At the time this separation occurs the mandrel 28 should have moved down only a minimum distance, if at all. Any substantial movement of the mandrel at the time the pistons separate would indicate air in one of the chambers and steps should be taken to remove this air to provide chambers which are full of hydraulic fluid or almost completely full of hydraulic fluid. It will be appreciated that the two piece piston 29 makes this test of the system possible without the use of complicated procedures or equipment.

After the actuator has been tested it is made up with the tubing string as shown in FIG. 1. While only a single spring 49 is illustrated in FIG. 1, it will be understood that springs of different strength or stacked springs might be utilized to provide for different spring force.

The string is run in until the stop 27 on the actuator seats on the packer 14. Further lowering of the tubing 18 will actuate the valve 21 to dump the fluid in the tubing 18 and open the tubing to the surface.

At this time a pressure probe may be run into the well and landed in the transducer fitting 17 and static pressure in formation 12 and the bottom of the well measured and recorded or transmitted back to the surface on an electric line if such be desired.

After static pressure has been determined it is usually desirable to flow the well and determine the condition of the well while flowing. For this purpose the tubing casing annulus will be subjected to pressure which will act against the downwardly facing pressure responsive surface on the piston 29 driving the piston upwardly against the force of the spring 49. This in turn will drive the mandrel 28 downwardly, shifting the foot valve to open position and permitting flow from the open hole below the packer, through the foot valve and into the tubing 18 and thence to the surface.

When it is desired to close the foot valve 15, pressure is removed from the annulus and pressure within the tubing plus the force exerted by the spring 49 return the mandrel 28 to its raised position and move the foot valve to closed position. It will be noted that during opening of the valve pressure within the chamber 45-41*a* is placed under compression and pressure is removed from the chamber 35-35*a* as upward movement of the piston 29 tends to pull a vacuum in the chamber 35-35*a*. In reverse manner, when the spring 49 and tubing pressure are urging the piston 29 downwardly, fluid within the chamber 35-35*a* is placed in compression and there is a tendency to pull a vacuum in the chamber 45-45*a*. In each case one of the chambers is under compression so there is a positive transmission of force through the hydraulic fluid within the chamber to cause positive movement of the mandrel 28 in response to movement of the outer piston 29. It will be appreciated that as the outer piston and mandrel reciprocate the two chambers maintain a substantially constant volume, but if there is any difference in volume as piston and mandrel reciprocate the two piece outer piston 29 is free to move apart slightly and compensate for a difference in volume which would place the fluid in chamber 35-35*a* in compression.

The foregoing disclosure and description of the invention is illustrative and explanatory thereof and various changes in the size, shape and materials, as well as in the details of the illustrated construction may be made within the scope of the appended claims without departing from the spirit of the invention.

What is claimed is:

1. An actuator comprising:

a tubular body adapted to be connected to a well pipe;

a tubular mandrel and a tubular position mounted with the body for reciprocal movement relative thereto;

spaced seal means between said body and mandrel;

spaced seal means between said body and piston;

means comprising said body, mandrel, piston and seal means defining a first closed fluid chamber;

means comprising said body, mandrel, piston and seal means defining a second closed fluid chamber;

said chambers filled with hydraulic fluid and each maintaining a constant volume with reciprocation of said mandrel and piston;

a pressure responsive surface on at least one of said mandrel and piston exposed to ambient pressure; and resilient means opposing movement of said one of said mandrel and piston by ambient pressure;

movement of said mandrel and piston increasing pressure in one of said chambers and reducing pressure in the other of said chambers.

2. The actuator of claim 1 wherein one of said piston and mandrel is provided by two telescoping parts with seal means therebetween.

3. The actuator of claim 1 wherein both the piston and mandrel have pressure responsive surfaces, one exposed to pressure conditions internally of the body and the other exposed to pressure conditions externally of the body.

4. The actuator of claim 1 wherein one of the mandrel and piston has a seal means adapted to seal with the bore wall in a well packer.

5. An actuator comprising:

a tubular body adapted to be connected to a well pipe;

a tubular mandrel reciprocal in the body and carrying spaced upper and lower inner pistons;

an outer tubular piston reciprocal on the body and having a downwardly facing pressure responsive surface;

said outer piston provided by upper and lower telescoped pistons with a sliding seal therebetween;

resilient means urging said outer piston downward relative to said body;

sliding seal means between said inner pistons and body, and between said mandrel and body;

upper, intermediate and lower sliding seal means between said outer piston body;

means comprising said body, upper inner piston, mandrel and associated seal means, and said body, outer piston and associated upper and intermediate seal means defining an upper closed fluid chamber;

means comprising said body, lower inner piston, mandrel and associated seal means, and said body, outer piston and associated intermediate and lower seal means defining a lower closed fluid chamber;

said telescoping piston seal exposed to one of said fluid chambers;

said chambers filled with hydraulic fluid and each maintaining a constant volume with reciprocation of said tubular mandrel and outer tubular piston; and movement of said mandrel and piston increasing pressure in one of said chambers and reducing pressure in the other chamber.

6. The actuator of claim 5 in combination with seal means on the mandrel adapted to seal with the bore wall in a well packer.

7. The actuator of claim 5 wherein the tubular mandrel has a downwardly facing pressure responsive surface exposed to pressure within the mandrel.

* * * * *

UNITED STATES PATENT AND TRADEMARK OFFICE

CERTIFICATE OF CORRECTION

PATENT NO. : 4,252,188

DATED : February 24, 1981

INVENTOR(S) : John V. Fredd

It is certified that error appears in the above—identified patent and that said Letters Patent is hereby corrected as shown below:

Column 4, Line 64, change "position" to -- piston --.

Signed and Sealed this

*Twenty-first* Day of *August 1984*

[SEAL]

*Attest:*

GERALD J. MOSSINGHOFF

*Attesting Officer*

*Commissioner of Patents and Trademarks*